US007744022B1

(12) United States Patent
Fugere

(10) Patent No.: US 7,744,022 B1
(45) Date of Patent: Jun. 29, 2010

(54) FLUID DISPENSE TIPS

(75) Inventor: Jeffrey P. Fugere, Sandown, NH (US)

(73) Assignee: DL Technology, LLC, Haverhill, MA (US)

( * ) Notice: Subject to any disclaimer, the term of this patent is extended or adjusted under 35 U.S.C. 154(b) by 0 days.

(21) Appl. No.: 11/733,517

(22) Filed: Apr. 10, 2007

Related U.S. Application Data

(60) Continuation of application No. 11/063,785, filed on Feb. 23, 2005, now Pat. No. 7,207,498, which is a division of application No. 10/304,349, filed on Nov. 26, 2002, now Pat. No. 6,896,202, which is a division of application No. 09/491,615, filed on Jan. 26, 2000, now Pat. No. 6,547,167.

(60) Provisional application No. 60/117,201, filed on Jan. 26, 1999, provisional application No. 60/163,938, filed on Nov. 8, 1999.

(51) Int. Cl.
*B05B 1/00* (2006.01)
*A62C 31/02* (2006.01)

(52) U.S. Cl. ..... 239/591; 239/589

(58) Field of Classification Search ..... 239/591, 239/589, DIG. 19, 590.5, 592–595; 222/420, 222/566

See application file for complete search history.

(56) References Cited

U.S. PATENT DOCUMENTS 1,453,161 A 4/1923 Murphy et al.
2,269,823 A 1/1942 Kreiselman
2,656,070 A 10/1953 Linder
2,933,259 A 4/1960 Raskin
3,355,766 A 12/1967 Causemann
3,394,659 A 7/1968 Van Alen
3,507,584 A 4/1970 Robbins, Jr.
3,693,884 A 9/1972 Snodgrass et al.

(Continued)

FOREIGN PATENT DOCUMENTS

EP 0110591 A1 6/1984
EP 0110591 B1 10/1986

OTHER PUBLICATIONS

Karassik, et al., "Pump Handbook" Second Ed., McGraw Hill Inc., 1986, p. 9.30.

(Continued)

*Primary Examiner*—Davis Hwu
(74) *Attorney, Agent, or Firm*—Mills & Onello, LLP

(57) ABSTRACT

A fluid dispense tip includes a bevel at an opening to reduce the amount of surface tension, or "land", at the opening. The bevel is formed by grinding in a longitudinal direction such that any tooling scars resulting from the grinding operation are likewise longitudinally oriented, further reducing the amount of surface tension in the tip, thereby leading to heightened dispensing accuracy. The tip may be machined from stock as a unitary piece, to increase its lifetime, and may be formed with a bore of a relatively large diameter that is tapered down to a smaller diameter near the tip opening, to allow for delivery of fluid through the tip body at a decreased pressure. A cleaning tool may be provided for removing residual material from the inner surfaces of the tip. A removable liner sleeve may be provided within the bore to reduce the effective inner diameter of the dispense tip.

48 Claims, 15 Drawing Sheets

U.S. PATENT DOCUMENTS

| | | | | |
|---|---|---|---|---|
| 3,734,635 | A | | 5/1973 | Blach et al. |
| 3,811,601 | A | | 5/1974 | Reighard et al. |
| 3,938,492 | A | | 2/1976 | Mercer, Jr. |
| 3,963,151 | A | | 6/1976 | North, Jr. |
| 4,004,715 | A | | 1/1977 | Williams et al. |
| 4,077,180 | A | | 3/1978 | Agent et al. |
| 4,116,766 | A | | 9/1978 | Poindexter et al. |
| 4,168,942 | A | | 9/1979 | Firth |
| 4,239,462 | A | | 12/1980 | Dach et al. |
| 4,258,862 | A | | 3/1981 | Thorsheim |
| 4,312,630 | A | | 1/1982 | Travaglini |
| 4,339,840 | A | | 7/1982 | Monson |
| 4,346,849 | A | | 8/1982 | Rood |
| 4,377,894 | A | | 3/1983 | Yoshida |
| 4,386,483 | A | | 6/1983 | Schlaefli |
| 4,408,699 | A | | 10/1983 | Stock |
| 4,513,190 | A | | 4/1985 | Ellett et al. |
| 4,572,103 | A | | 2/1986 | Engel |
| 4,579,286 | A | | 4/1986 | Stoudt |
| 4,584,964 | A | | 4/1986 | Engel |
| 4,610,377 | A | | 9/1986 | Rasmussen |
| 4,705,218 | A | | 11/1987 | Daniels |
| 4,705,611 | A | | 11/1987 | Grimes et al. |
| 4,743,243 | A | | 5/1988 | Vaillancourt |
| 4,785,996 | A | | 11/1988 | Ziecker et al. |
| 4,803,124 | A | | 2/1989 | Kunz |
| 4,836,422 | A | | 6/1989 | Rosenberg |
| 4,859,073 | A | | 8/1989 | Howseman, Jr. et al. |
| 4,917,274 | A | | 4/1990 | Asa et al. |
| 4,919,204 | A | | 4/1990 | Baker et al. |
| 4,935,015 | A | | 6/1990 | Hall |
| 4,941,428 | A | | 7/1990 | Engel |
| 4,969,602 | A | | 11/1990 | Scholl |
| 5,002,228 | A | | 3/1991 | Su |
| 5,106,291 | A | | 4/1992 | Gellert |
| 5,130,710 | A | | 7/1992 | Salazar |
| 5,161,427 | A | | 11/1992 | Fukuda et al. |
| 5,176,803 | A | | 1/1993 | Barbuto et al. |
| 5,177,901 | A | | 1/1993 | Smith |
| 5,186,886 | A | * | 2/1993 | Zerinvary et al. ..... 266/237 |
| RE34,197 | E | | 3/1993 | Engel |
| 5,217,154 | A | | 6/1993 | Elwood et al. |
| 5,265,773 | A | | 11/1993 | Harada |
| 5,348,453 | A | | 9/1994 | Baran et al. |
| 5,407,101 | A | | 4/1995 | Hubbard |
| 5,452,824 | A | | 9/1995 | Danek et al. |
| 5,535,919 | A | | 7/1996 | Ganzer et al. |
| 5,553,742 | A | | 9/1996 | Maruyama et al. |
| 5,564,606 | A | | 10/1996 | Engel |
| 5,567,300 | A | | 10/1996 | Datta et al. |
| 5,685,853 | A | | 11/1997 | Bonnet |
| 5,699,934 | A | | 12/1997 | Kolcun et al. |
| 5,765,730 | A | | 6/1998 | Richter |
| 5,785,068 | A | | 7/1998 | Sasaki et al. |
| 5,795,390 | A | | 8/1998 | Cavallaro |
| 5,803,661 | A | | 9/1998 | Lemelson |
| 5,814,022 | A | | 9/1998 | Antanavich et al. |
| 5,819,983 | A | | 10/1998 | White et al. |
| 5,823,447 | A | | 10/1998 | Maybach |
| 5,823,747 | A | | 10/1998 | Ciavarini et al. |
| 5,833,851 | A | | 11/1998 | Adams et al. |
| 5,837,892 | A | | 11/1998 | Cavallaro et al. |
| 5,886,494 | A | | 3/1999 | Prentice et al. |
| 5,903,125 | A | | 5/1999 | Prentice et al. |
| 5,904,377 | A | | 5/1999 | Throup |
| 5,918,648 | A | | 7/1999 | Carr et al. |
| 5,925,187 | A | | 7/1999 | Freeman et al. |
| 5,927,560 | A | | 7/1999 | Lewis et al. |
| 5,931,355 | A | | 8/1999 | Jefferson |
| 5,947,022 | A | | 9/1999 | Freeman et al. |
| 5,947,509 | A | | 9/1999 | Ricks et al. |
| 5,957,343 | A | | 9/1999 | Cavallaro |
| 5,971,227 | A | | 10/1999 | White et al. |
| 5,984,147 | A | | 11/1999 | Van Ngo |
| 5,985,029 | A | | 11/1999 | Purcell |
| 5,985,206 | A | | 11/1999 | Zabala et al. |
| 5,985,216 | A | | 11/1999 | Rens et al. |
| 5,992,688 | A | | 11/1999 | Lewis et al. |
| 5,993,183 | A | | 11/1999 | Laskaris et al. |
| 5,995,788 | A | | 11/1999 | Baek |
| 6,007,631 | A | | 12/1999 | Prentice et al. |
| 6,017,392 | A | | 1/2000 | Cavallaro |
| 6,025,689 | A | | 2/2000 | Prentice et al. |
| 6,068,202 | A | | 5/2000 | Hynes et al. |
| 6,082,289 | A | | 7/2000 | Cavallaro |
| 6,085,943 | A | | 7/2000 | Cavallaro et al. |
| 6,093,251 | A | | 7/2000 | Carr et al. |
| 6,112,588 | A | | 9/2000 | Cavallaro et al. |
| 6,119,895 | A | | 9/2000 | Fugere et al. |
| 6,126,039 | A | | 10/2000 | Cline et al. |
| 6,132,396 | A | | 10/2000 | Antanavich et al. |
| 6,157,157 | A | | 12/2000 | Prentice et al. |
| 6,196,521 | B1 | | 3/2001 | Hynes et al. |
| 6,199,566 | B1 | | 3/2001 | Gazewood |
| 6,206,964 | B1 | | 3/2001 | Purcell et al. |
| 6,207,220 | B1 | | 3/2001 | Doyle et al. |
| 6,214,117 | B1 | | 4/2001 | Prentice et al. |
| 6,216,917 | B1 | | 4/2001 | Crouch |
| 6,224,671 | B1 | | 5/2001 | Cavallaro |
| 6,224,675 | B1 | | 5/2001 | Prentice et al. |
| 6,234,358 | B1 | | 5/2001 | Romine et al. |
| 6,250,515 | B1 | | 6/2001 | Newbold et al. |
| 6,253,957 | B1 | | 7/2001 | Messerly et al. |
| 6,253,972 | B1 | | 7/2001 | DeVito et al. |
| 6,257,444 | B1 | | 7/2001 | Everett |
| 6,258,165 | B1 | | 7/2001 | Cavallaro |
| 6,299,078 | B1 | | 10/2001 | Fugere |
| 6,322,854 | B1 | | 11/2001 | Purcell et al. |
| 6,324,973 | B2 | | 12/2001 | Rossmeisl et al. |
| 6,371,339 | B1 | | 4/2002 | White et al. |
| 6,378,737 | B1 | | 4/2002 | Cavallaro et al. |
| 6,383,292 | B1 | | 5/2002 | Brand et al. |
| 6,386,396 | B1 | | 5/2002 | Strecker |
| 6,391,378 | B1 | | 5/2002 | Carr et al. |
| 6,395,334 | B1 | | 5/2002 | Prentice et al. |
| 6,412,328 | B1 | | 7/2002 | Cavallaro et al. |
| 6,453,810 | B1 | | 9/2002 | Rossmeisl et al. |
| 6,511,301 | B1 | | 1/2003 | Fugere |
| 6,514,569 | B1 | | 2/2003 | Crouch |
| 6,540,832 | B2 | | 4/2003 | Cavallaro |
| 6,547,167 | B1 | | 4/2003 | Fugere |
| 6,562,406 | B1 | | 5/2003 | Chikahisa et al. |
| 6,619,198 | B2 | | 9/2003 | Rossmeisl et al. |
| 6,626,097 | B2 | | 9/2003 | Rossmeisl et al. |
| 6,851,923 | B1 | | 2/2005 | Fugere |
| 6,892,959 | B1 | | 5/2005 | Fugere |
| 6,896,202 | B1 | | 5/2005 | Fugere |
| 6,957,783 | B1 | | 10/2005 | Fugere |
| 6,981,664 | B1 | | 1/2006 | Fugere |
| 6,983,867 | B1 | | 1/2006 | Fugere |
| 7,000,853 | B2 | | 2/2006 | Fugere |
| 7,178,745 | B1 | | 2/2007 | Fugere |
| 7,207,498 | B1 | | 4/2007 | Fugere |
| 7,331,482 | B1 | | 2/2008 | Fugere |
| RE40,539 | E | | 10/2008 | Fugere |
| 7,448,857 | B1 | | 11/2008 | Fugere |
| 2002/0007227 | A1 | | 1/2002 | Prentice et al. |
| 2003/0000462 | A1 | | 1/2003 | Prentice et al. |
| 2003/0038190 | A1 | | 2/2003 | Newbold et al. |
| 2003/0066546 | A1 | | 4/2003 | Bibeault et al. |
| 2003/0084845 | A1 | | 5/2003 | Prentice et al. |
| 2003/0091727 | A1 | | 5/2003 | Prentice et al. |
| 2003/0132243 | A1 | | 7/2003 | Engel |
| 2004/0089228 | A1 | | 5/2004 | Prentice et al. |

OTHER PUBLICATIONS

Sela, Uri, et al., "Dispensing Technology: The Key to High-Quality, High-Speed, Die-Bonding", Microelectronics Manufacturing Technology, Feb. 1991, p. 47.

Ulrich, Rene J., "Epoxy Die Attach: The Challenge of Big Chips", Semiconductor International, Oct. 1994, p. 101.

* cited by examiner

FLUID DISPENSE TIPS

RELATED APPLICATIONS

This application is a Continuation of pending U.S. patent application Ser. No. 11/063,785, filed Feb. 23, 2005, which is a Divisional of U.S. patent application Ser. No. 10/304,349, filed Nov. 26, 2002, now U.S. Pat. No. 6,896,202, which is a Divisional of U.S. patent application Ser. No. 09/491,615, filed Jan. 26, 2000, now U.S. Pat. No. 6,547,167, which claims the benefit of U.S. Provisional Application No. 60/117,201, filed Jan. 26, 1999, and U.S. Provisional Application No. 60/163,938, field Nov. 8, 1999, the contents of each being incorporated herein by reference.

BACKGROUND OF THE INVENTION

Contemporary fluid dispense systems are well suited for dispensing precise amounts of fluid material at precise positions on a substrate. A pump transports the fluid to a dispense tip, also referred to as a "pin" or "needle", which is positioned over the substrate by a micropositioner, thereby providing patterns of fluid on the substrate as needed. As an example application, dispense tips can be utilized for depositing precise volumes of adhesives, for example, glue, resin, or paste, during a circuit board assembly process, in the form of dots for high-speed applications, or in the form of lines for providing underfill or encapsulation.

FIG. 1 is a perspective view of a conventional dispense tip 24. The dispense tip 24 includes a body 26 and a hollow neck 28. The body 26 attaches to a pump 22, for example by means of a thread, which controls the amount of fluid to be dispensed. The neck 28 is typically a hollow cylinder having a first end 31 which is positioned to overlap with an aperture formed in the body 26, and a second end 30 at which the fluid is dispensed.

As shown in the close-up perspective view of FIG. 2, the neck 28 is formed by rolling a flat portion of machined metal into a cylindrical form. A seam 40 is welded along the longitudinal axis, to seal the edges of the flat portion, using conventional seam welding techniques. In precision tips, the inner diameter of the opening at the second end 30 may be on the order of 0.030 inches in diameter. The thickness of the walls 32 may be on the order of 0.010 inches. A hole 29 is bored into the tip body 26, and the neck 28 is aligned with, and pressed into, the hole. As a consequence of rolling and welding, the inner diameter of the neck is often unpredictable due to inner collapse.

When fluid is released at the opening 30, a high degree of surface tension on the substrate is desired, such that the substrate receives and pulls the fluid from the tip 24. It is further desirable to minimize the surface tension of the neck 28 interface such that when the pin retracts from the substrate, dispensed fluid properly remains on the board. However, a certain degree of surface tension in the neck exists due to the thickness of the walls 32 of the neck 28 at the opening 30.

It has been observed that the surface tension, or "land", at the opening 30 of the neck 28 can be reduced by tapering the outer diameter of the neck 28 to a sharp point. As shown in FIG. 3, the distal end 30 of the neck 28 is sharpened using a surface grinder 42. The neck 28 is positioned perpendicular to the motion of the grinder 42 as shown, to thereby generate a taper 36, or bevel, on the distal end of the neck 28. The tapered portion 36 varies in thickness from the outer diameter of the neck 28 at position 37A to a sharpened point 37B at the opening 30. For the example given above, by providing a taper 36, the amount of land at the opening may be reduced from 0.010" of contact about the perimeter of the opening, to 0.001" of contact. In this manner, the surface tension at the junction of the pin and fluid is highly reduced, leading to a higher degree of dispensing precision.

As shown in the close-up perspective view of FIG. 4, as a consequence of formation of the taper 36 in the manner described above, with the neck 28 positioned substantially perpendicular to the grinding wheel 42, tooling scars, in the form of radial rings 38, can form on the taper 36 due to surface variations in the grinding wheel 42. These rings 38 provide ledges or shelves that can lead to additional surface tension on the taper 36, which, in turn, capture fluid material when the tip is released from the substrate following a fluid deposit. This, in turn, can cause fluid to be dispensed inconsistently on the substrate during subsequent deposits, leading to inaccurate results.

SUMMARY OF THE INVENTION

The present invention is directed to a tapered dispense tip grinding method, and a dispense tip processed according to such a method, that overcome the aforementioned limitations associated with conventional techniques. In the present invention, the tip is presented to the grinding wheel in a longitudinal orientation—the longitudinal axis of the neck of the tip is substantially aligned with the direction of movement of the grinding wheel. In this manner, the taper is formed without the radial rings of conventional techniques, thereby providing a tip with further-reduced surface tension and therefore increased dispensing precision capability.

In a second aspect, the present invention is directed to an electropolishing technique whereby a beveled tip is electropolished to further buff, or remove, tool marks generated during bevel formation. In this manner, burrs and pits are removed from the surfaces of the tip. This aspect is applicable to treatment of both conventional laterally-ground and the inventive longitudinally-ground tapered tips. Electroplating may further be applied to external and internal tip surfaces to enhance surface lubricity.

In a third aspect, the present invention is directed to a dispense tip formed in a solid unitary piece, machined from stock. By machining the neck opening, potential inner collapse of the neck due to rolling as in prior configurations is avoided. Furthermore, alignment of the neck with the body of the tip is unnecessary and complicated assembly procedures are thereby avoided. The unitary tips further offer the advantage of a robust neck, avoiding the need for bonding of the neck to an alignment foot. Because of the added robustness, the unitary tips are more amenable to deployment with longer-length necks than conventional configurations.

In a preferred embodiment of the third aspect, the neck is of a first inner diameter along a majority of its length, and of a second inner diameter proximal to the opening, the first inner diameter being greater than the second inner diameter. This configuration allows for delivery of the dispensed fluid to the opening at a relatively low pressure, as compared to conventional tips having a single, narrow diameter over their lengths, and is especially attractive to dispensing applications that require smaller diameter tips.

A preferred embodiment of the third aspect of the present invention comprises a unitary fluid dispense tip. The tip includes an elongated cylindrical neck having a longitudinal axis. A bore is machined in the neck centered at the longitudinal axis, the bore having an input end and an output end. The input end of the bore has an inner surface of a first inner diameter and the output end of the bore has an inner surface of a second inner diameter, the first inner diameter being greater than the second inner diameter. An inner taper is machined in the bore such that the inner surface of the bore transitions gradually from the first inner diameter to the second inner diameter.

The inner taper is preferably proximal to the output end of the neck, and is preferably formed at an angle of approximately 20-40 degrees relative to the longitudinal axis of the neck. The neck is preferably formed with a body about the input end of the neck, the body including a funnel adapted for delivering fluid to the input end of the neck. The body may optionally be formed separately from the neck, in which case the body and neck are preferably coupled via press-fitting, bonding, or welding. An alignment foot may be coupled to the body so as to provide a vertical gap below the neck during a dispensing operation. Multiple necks may be mounted to the body, in which case the funnel is adapted for delivering fluid to the multiple input ends of the multiple necks.

A liner sleeve may be inserted in the neck of the dispense tip in order to reduce material flow for low-viscosity materials. The sleeve may comprise, for example, Teflon™ tubing, inserted by a sleeve insertion tool adapted to push the tubing into the neck, and removed by a sleeve removal tool.

In a fourth aspect, the present invention is directed to a cleaning tool adapted for cleaning the inner surfaces of the neck of the dispense tip. The cleaning tool includes an elongated body that serves as a handle during a cleaning operation, and a sharpened shovel adapted to interface with, and shaped to correspond with, the tapered inner diameter of the tip neck. The shovel is located on a bevel, the bevel having an angle substantially similar to the neck taper to allow the shovel to access the tapered portion of the neck. Optional drill flutes may be formed on the cleaning tool body for removing a bulk of the material from the inner surface during a cleaning operation. In this manner, buildup of hardened material is avoided, and dispense tip lifetime is extended.

In a fifth aspect, the present invention is further directed to a cleaning kit for cleaning dispense tips configured in accordance with the present invention, thereby extending the useful lifetime of the dispense tips. The kit is preferably enclosed in a plastic, non-scratch compartmentalized receptacle, and includes a pin-vise, magnet, syringe and plunger, magnifying glass, cleaning wires, and cleaning tools. The pin vise is adapted to secure the miniature wires and drills during a cleaning operation. The magnet is helpful for locating the wires and drills on a work surface, for example by using a sweeping motion of the magnet over the surface. The syringe and plunger are provided for flushing out the dispense tips following cleaning with the wires and fluted drill bits. Alcohol is a preferred liquid for the flushing operation. A magnifying glass helps with inspection of the dispense tips during, and following, cleaning. Cleaning wires include cleaning wires with tapered ends for eased insertion into the dispense tips. Cleaning tools include fluted drill bits for coarse cleaning of the inner necks, a shoveled cleaning tool, described above, for cleaning the inner taper of unitary dispense tips, and a liner insertion tool, described above, for inserting liners into the unitary dispense tips.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 5A:
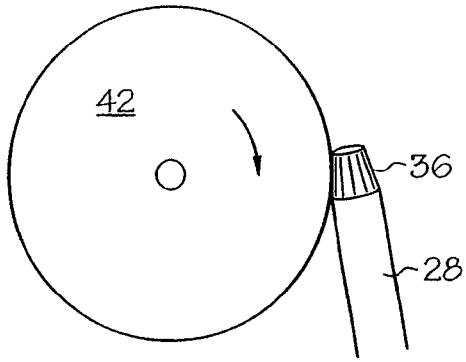
FIG. 5A and FIG. 5B are side and front views of longitudinal grinding of a tip bevel in accordance with the present invention.
Figure 5B:
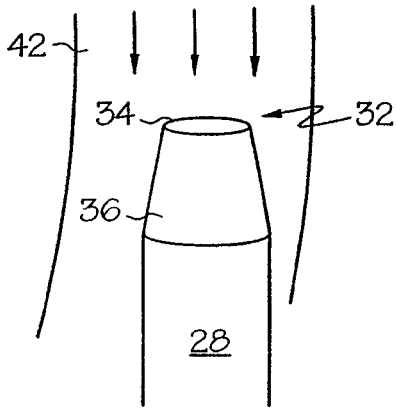

FIGS. 5A and 5B are side and front views respectively depicting longitudinal grinding of a dispense tip bevel in accordance with the present invention.

In FIG. 5A, a grind wheel rotates in a clockwise direction, for example at a speed of 3,200 revolutions per minute (RPM). The neck 28 of the dispense tip is presented to the grinding wheel such that the longitudinal axis of the neck substantially aligns with the direction of travel of the grinding wheel. In this manner, a bevel 36 can be formed in a distal end of the neck 28 such that any resulting tooling scars that arise due to the texture of the grinding wheel are substantially longitudinally oriented; in other words, substantially parallel to the longitudinal axis of the dispense tip.

Figure 6:
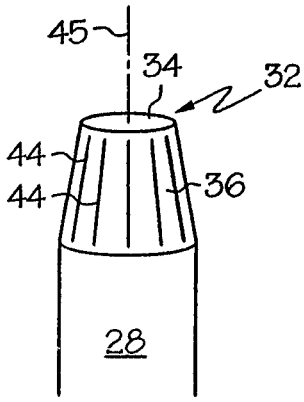
FIG. 6 is a close-up perspective view of the longitudinal tooling scars resulting from longitudinal tip grinding in accordance with the present invention.

As seen in the close-up diagram of FIG. 6, a bevel 36 is formed on the dispense tip such that the surface area, or "land" of the tip interface 34 at the opening 32, is substantially reduced. With longitudinal grinding, longitudinal scars 44 are formed on the tip. All tooling marks are substantially parallel to the longitudinal axis 45 of the tip neck 28. In this manner, any fluid dispensed from the tip that brushes up against the surface of the bevel 36 is more likely to roll off, and therefore be released, from the tip, as opposed to conventional radial rings, or tooling scars, which tend to capture and collect droplets of the dispensed material.

Figure 7:
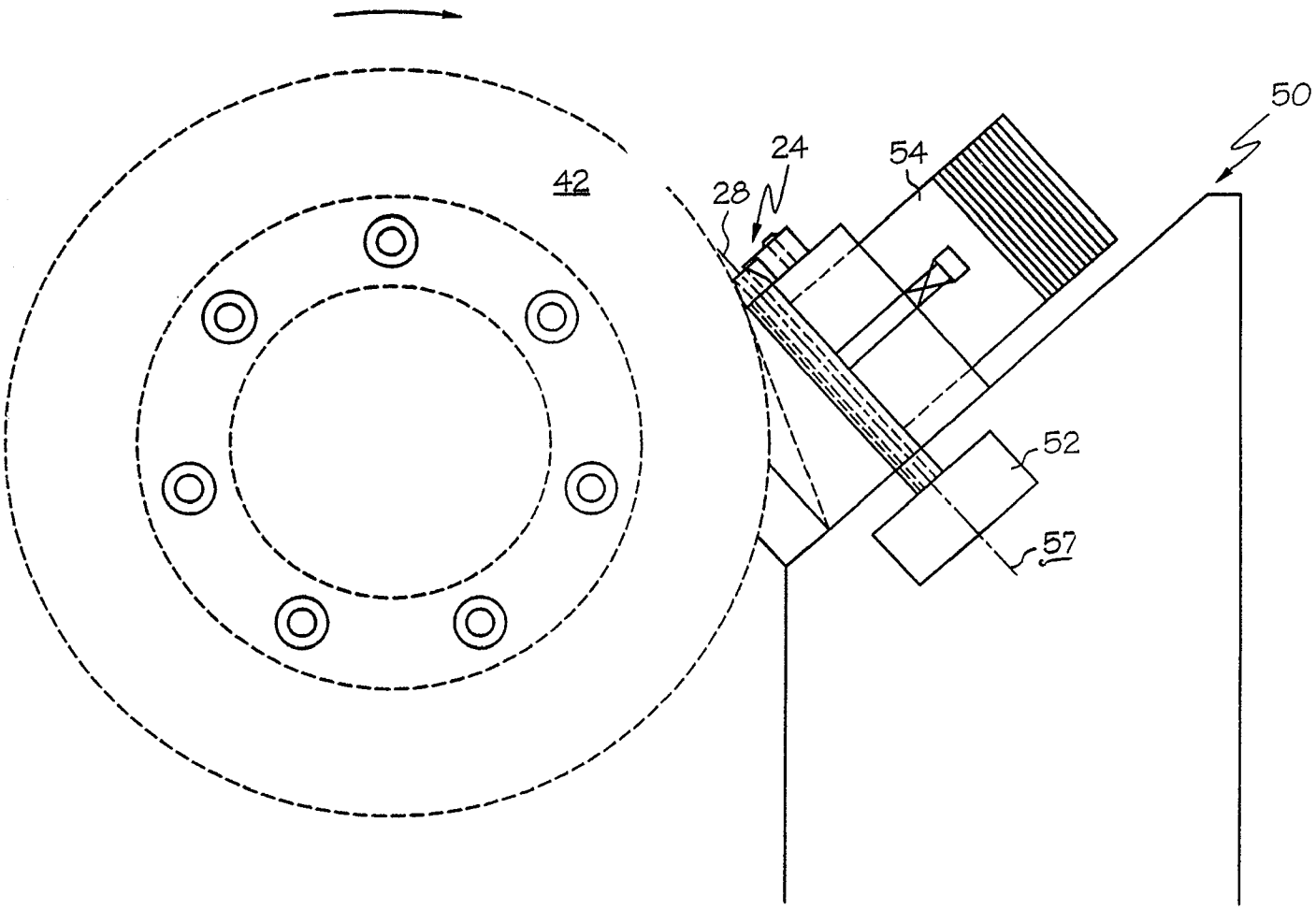
FIG. 7 is a side view of a tooling fixture for supporting a dispense tip in proper alignment for longitudinal grinding, in accordance with the present invention.

FIG. 7 is a side view of an alignment unit 50 for aligning a dispense tip 24 in proper position for longitudinal grinding at the grinding wheel 42, as described above. The alignment unit includes support 54 for supporting and positioning the dispense tip 24, and further includes a motor 52, for optionally rotating the dispense tip 24 about its longitudinal axis 57 in a continuous clockwise or counter-clockwise direction during grinding, to ensure symmetric bevel formation.

Figure 8A:
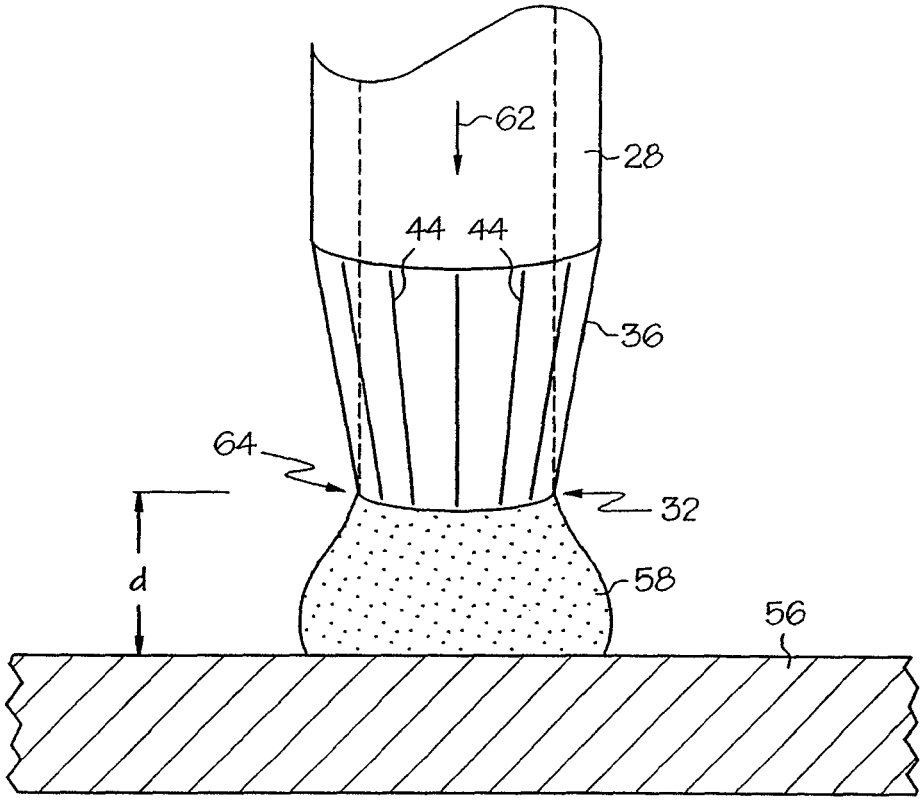
FIGS. 8A and 8B are side views depicting the dispensing of fluid material on a substrate in the form of a dot and of a line, respectively.
Figure 8B:
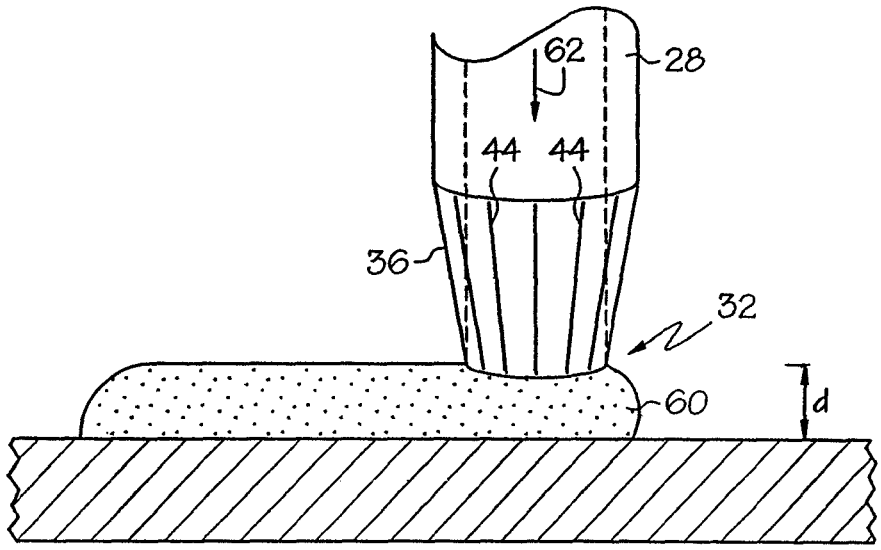

FIGS. 8A and 8B are side views depicting dispensing of fluid material 58 from a dispense tip 28 onto a substrate 56 in the form of a dot 58 in FIG. 8A and in the form of a line 60 in FIG. 8B. Material 58, 60 flowing in the direction of arrow 62 dispensed from the opening 32 of the dispense tip tends to cling to portions of the neck 28 near the opening 32. In FIG. 8A, a dot 58 is formed by positioning the dispense tip 28 over the substrate 56 at a precise location and pumping fluid 58 therefrom while the position of the dispense tip 28 and substrate 56 are fixed relative to each other. A fluid line 60 is formed in a similar manner in FIG. 8B by moving either, or both, the dispense tip 28 and substrate 56 laterally relative to each other, for example by use of a micropositioner. The distance d between the tip opening 32 and the upper surface of the substrate 56 is variable depending on the viscosity, volume, and desired depth of dispensed material, and depending on the geometry of the dispense tip 28.

As shown in FIG. 8A, dispensed material tends to cling to the side surfaces of the taper 36 at location 64 near the opening 32 as the tip is repeatedly positioned to dispense and separate from the dispensed fluid. As described above, longitudinal grinding of the bevel 36 causes any scars 44 to be parallel to the longitudinal axis of the neck 28 of the dispense tip and therefore such excess fluid 64 is less likely to cling thereto, as compared to the radial tooling marks of conventional embodiments.

Figure 9:
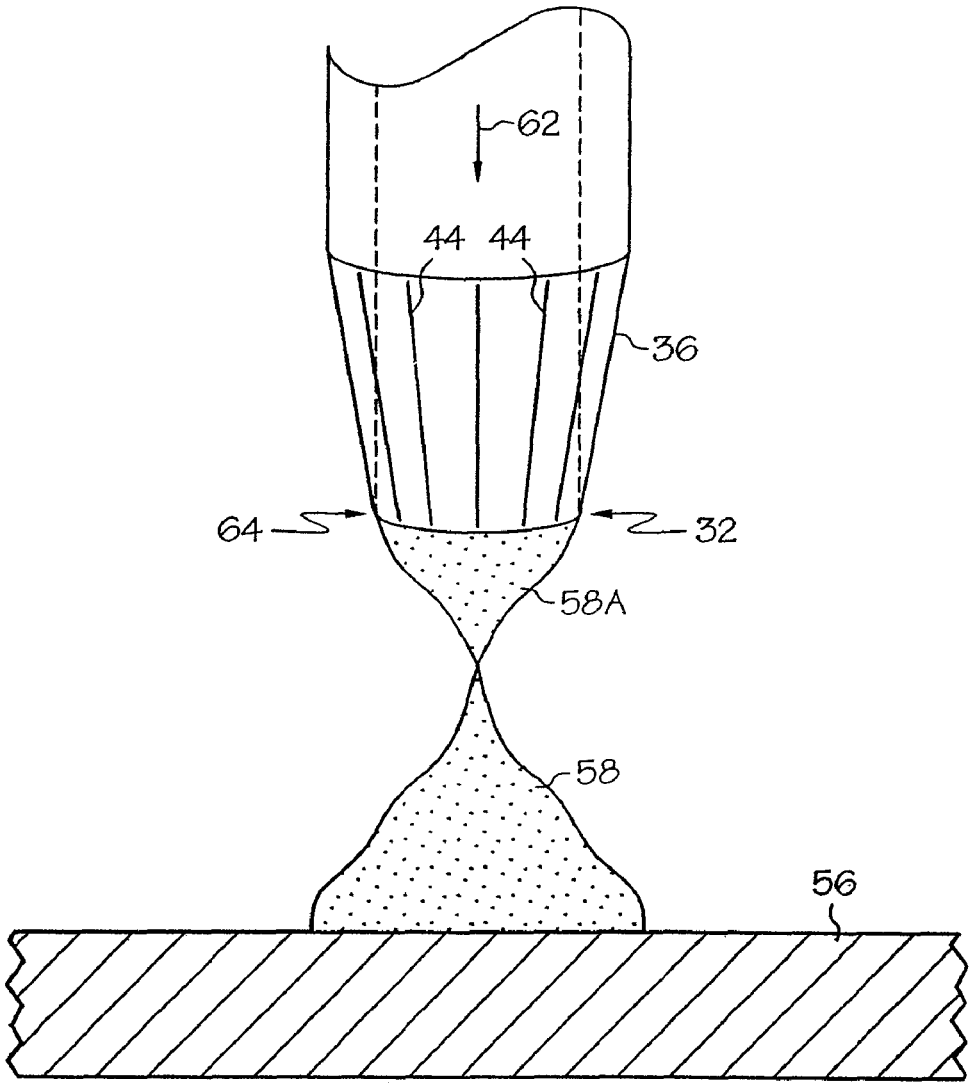
FIG. 9 is a side view of the dispense tip following dispensing of a dot on a substrate in accordance with the present invention.

FIG. 9 is a side view of a dispense tip following dispensing of a dot 58 in accordance with the present invention. As the needle ascends, material 58A pulls away from the dot 58. This phenomenon is referred to in the industry as "tailing", and is an adverse result of material that clings 64 and migrates up the sides of the needle along the taper 36. A problem associated with this effect is that the following dot dispensed will have an excess amount of material. As described above, a dispense tip having longitudinal tooling lines 44 according to the present invention helps to minimize this effect.

Figure 10A:
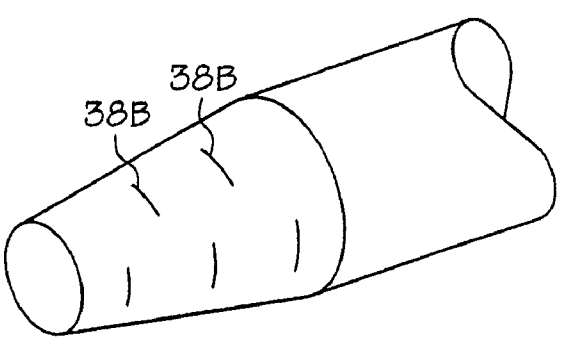
FIG. 10A and FIG. 10B illustrate buffing of a beveled tip according to the electropolishing technique of the present invention.
Figure 10A:
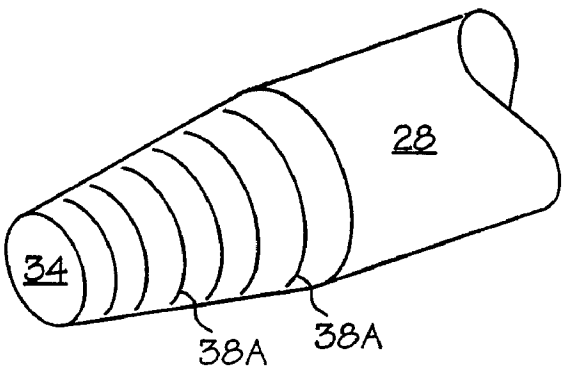
Figure 10B:
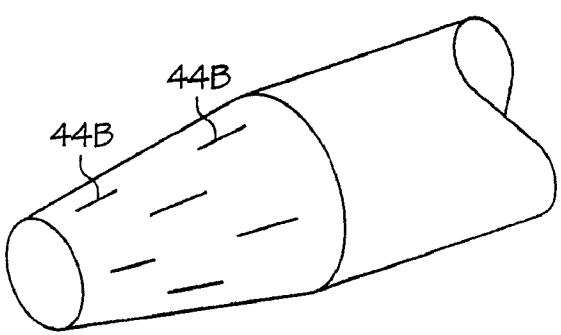
Figure 10B:
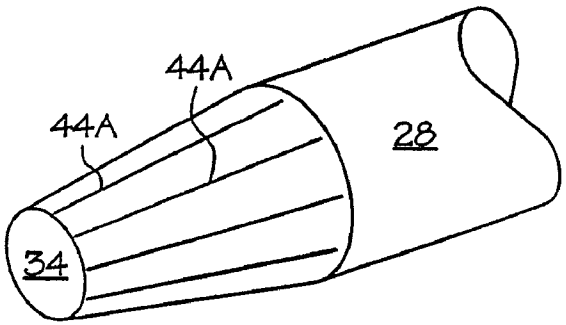

In a second aspect, the present invention is directed to an electropolishing technique for polishing the beveled tip in order to remove scuff or scratch marks resulting from grinding. This aspect is applicable to treatment of both conventional laterally-ground and the inventive longitudinally-ground tapered dispense tips. To that end, the beveled portion of a dispense tip having radial scars 38A or longitudinal scars 44A as shown in FIG. 10A is immersed in an electropolishing bath to enhance the finish of the tip and to quickly bring the tooled portions of the tip to a high luster and smooth finish. This results in a dispense tip having minimal radial scars 38B or longitudinal scars 44B as shown in FIG. 10B. This process further removes microscopic burrs that corrupt dispense flow and further functions as a final clean-up process for the dispense tips. Electropolishing units of the types applicable to the present invention are commercially available from a number of vendors, including ESMA, Inc. of South Holland, Ill. To effect electropolishing, electrodes are first attached to the dispense tip, and the tip and electrodes are submerged in a chemical solution, for example an acid bath. The electrodes are activated for a time period, for example two seconds, and are removed, and neutralized, for example by flushing in water.

Figure 11A:
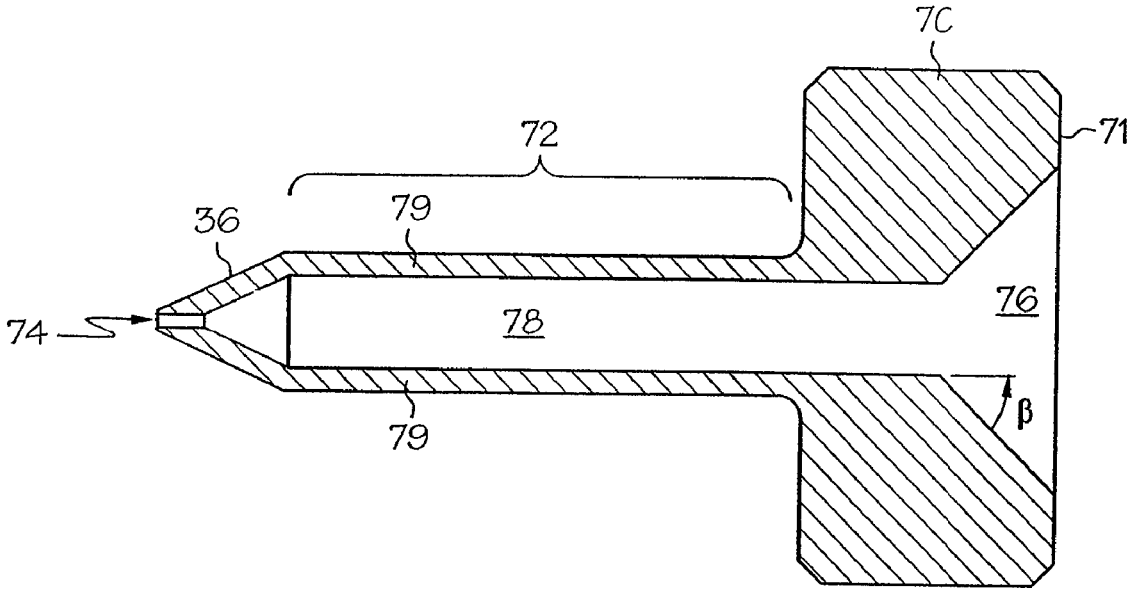
FIG. 11A is a cutaway side view of a unitary dispense tip in accordance with the present invention.

The present invention is further directed, in a third aspect, to a solid, machined, unitary dispense tip as shown in FIG. 11A. The unitary tip 84 includes a body 70 and a neck 72. The tip 84 is preferably machined from oversized stock by a lathe, the stock being of a diameter slightly larger than the desired body 70 diameter. In a high-production environment, the stock may be presented to the machining lathe by an automated stock feeder.

In an exemplary procedure for forming the unitary tip 84, the body 70 is held in the spindle of a lathe and a bulk portion of stock is removed about the neck 72. Next, a bore of diameter $D_2$ equal to the desired diameter of the opening 74 (see FIG. 11B) is formed concentric with the longitudinal center axis of the neck 72. The neck 72 and body 70 are next buffed and finished, and the body 70 is separated or cut from the stock. The rear face 71 of the body 70 is finished, and a neck bore 78 is formed through the body 70 and neck 78, the bore being concentric with the opening 74 and being of a diameter $D_1$, slightly larger than the diameter $D_2$ of the opening 74.

Figure 11B:
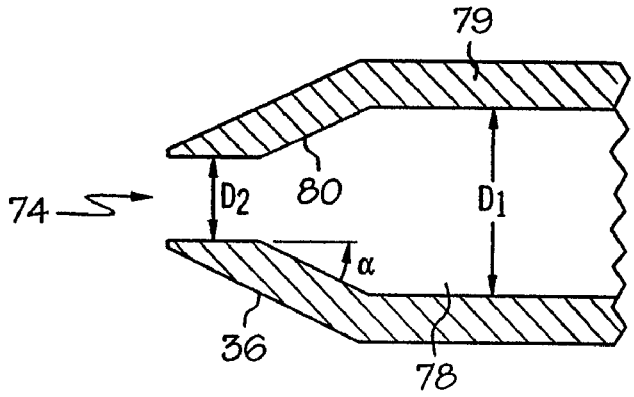
FIG. 11B is a close-up cutaway side view of the dispense tip neck, illustrating a tapered inner diameter near the opening of the neck in accordance with the present invention.

As shown in the close-up side view of FIG. 11B, the neck bore 78 stops short of the opening 74. At the interface of the neck bore 78 and opening 74, a taper 80 is formed to gradually conform the two diameters $D_1$, $D_2$. The taper 80 is preferably finished with a finishing drill to provide a smooth inner surface, as well as a predetermined taper angle $\alpha$ for the inner neck, for example 20-40 degrees. A funnel 76 is formed and finished in the body 70 at a taper angle $\beta$, for example 45 degrees. Other taper angles are equally applicable to the present invention, depending on the application. A bevel 36 is optionally formed near the opening 74, and is preferably longitudinally ground in accordance with the aforementioned techniques to provide the various advantages described above. While the above description illustrates formation of the inner taper 80 proximal to the opening 74, the invention is equally applicable to tips formed with an inner taper 80 toward the middle, or body end 70, of the neck 72.

Figure 1:
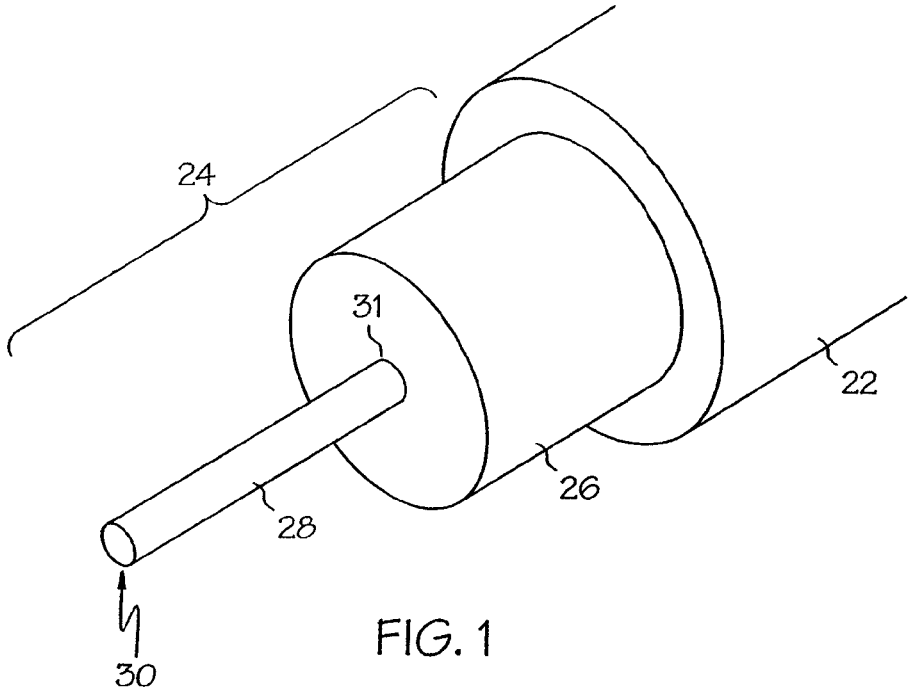
FIG. 1 is a perspective view of a conventional dispense tip mounted to a dispensing pump.
Figure 2:
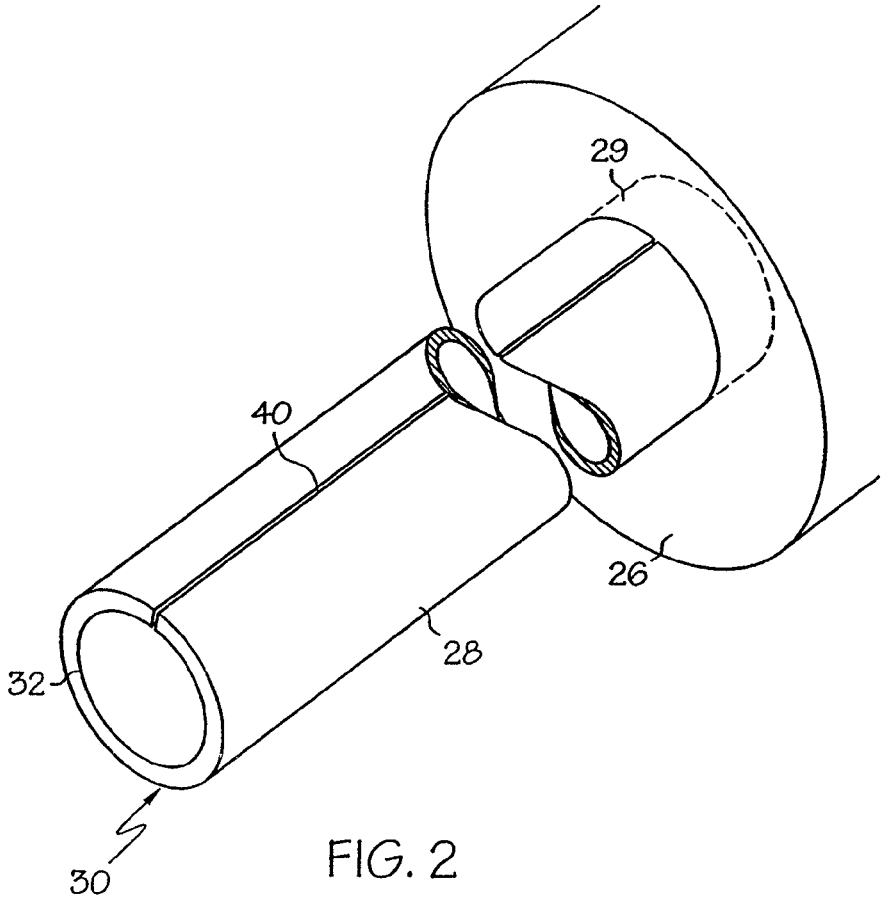
FIG. 2 is a close-up view of the neck of a conventional dispense tip.
Figure 3:
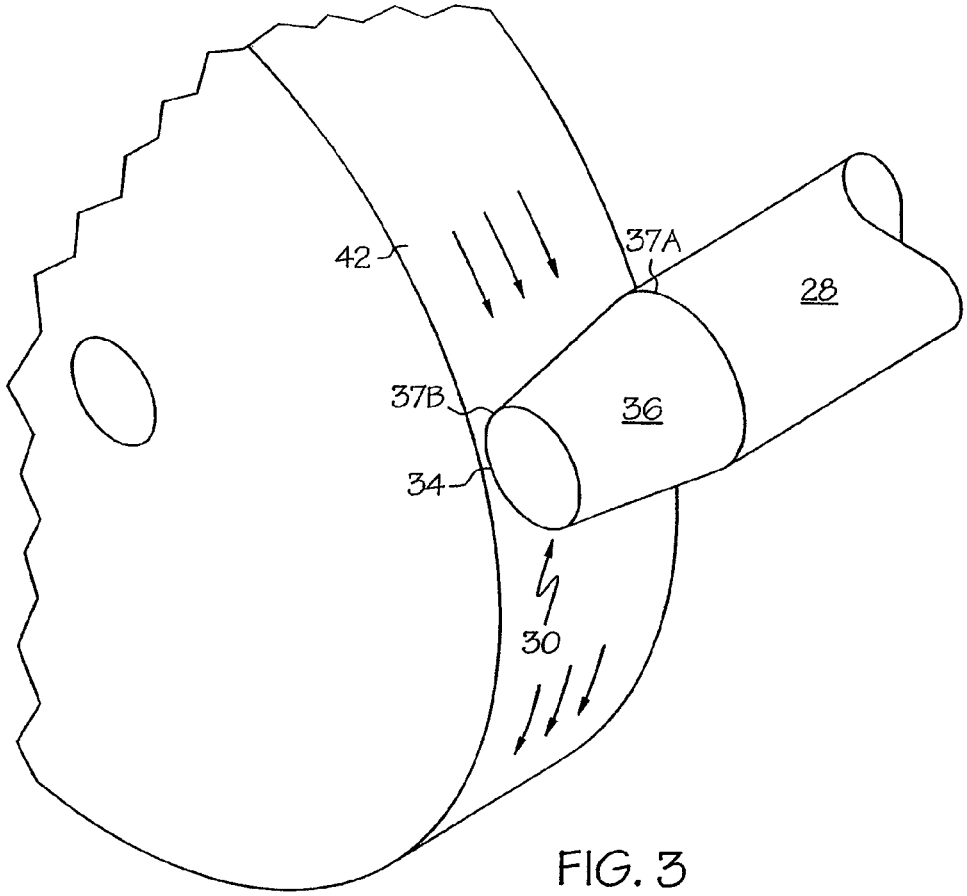
FIG. 3 is a perspective view of lateral grinding of a tip bevel in accordance with conventional techniques.
Figure 4:
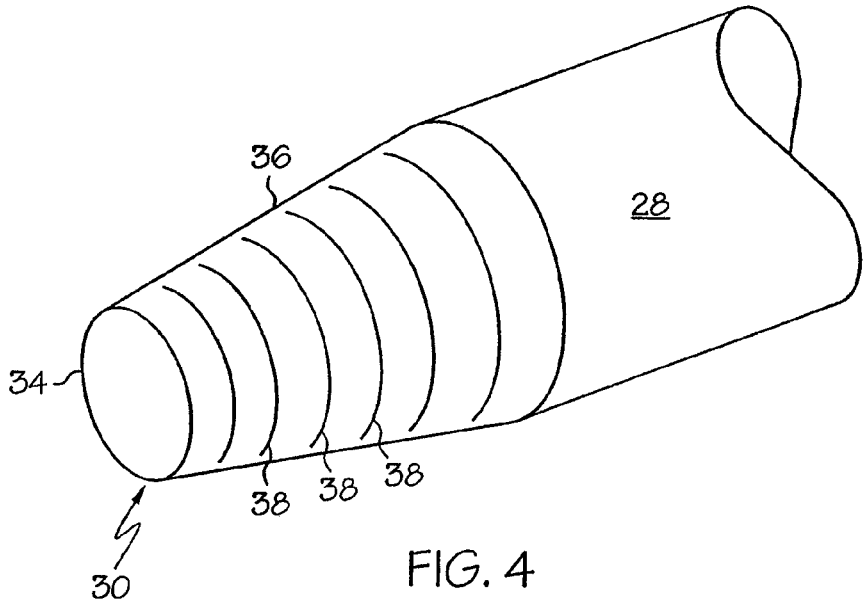
FIG. 4 is a perspective view of the radial scars formed on a tip bevel ground according to conventional lateral grinding techniques.

An important feature of this aspect of the invention is the ability to deliver fluid to an opening 74 of a relatively narrow inner diameter $D_2$ at relatively low pressure as compared to conventional tips (for example the rolled tip of FIG. 2) having the single narrow inner diameter $D_2$ over the length of the neck. The wider diameter $D_1$ along the length of the neck 72 allows for delivery of the fluid to the narrow diameter $D_2$ opening 74 at a relatively low pressure. This is especially helpful for small-gauge tips and allows for quicker dispensing, while lowering pressure requirements on the pump delivering the fluid.

Figure 12:
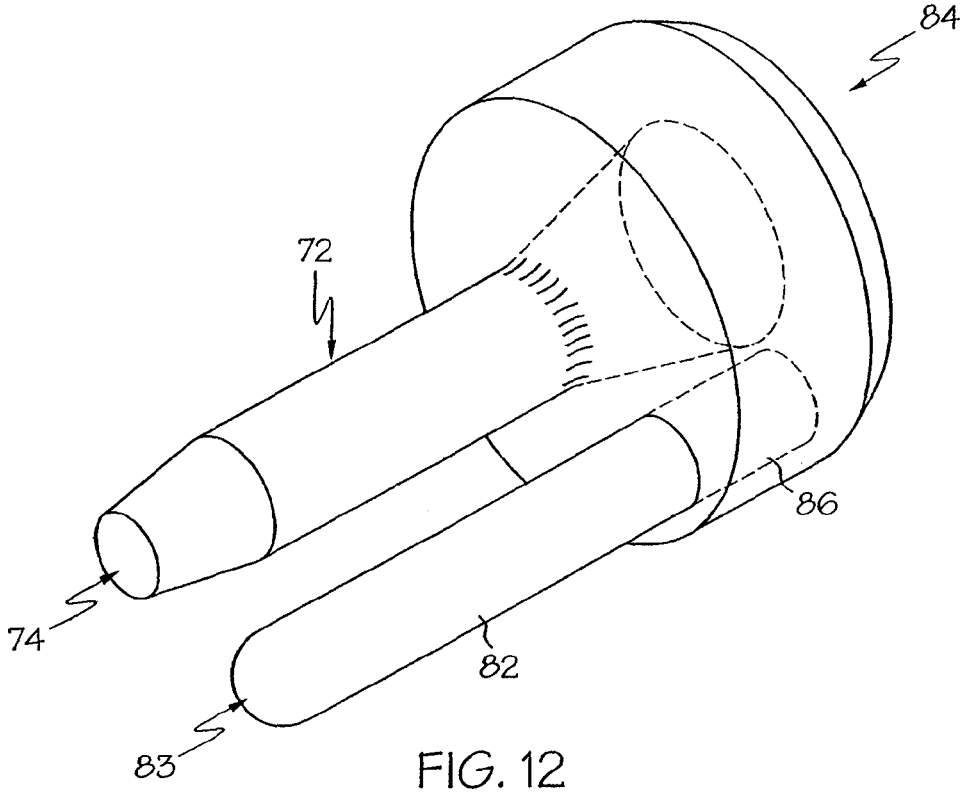
FIG. 12 is a perspective view of a unitary tip including a spacer foot in accordance with the present invention.

In an alternative embodiment, as shown in the perspective view of FIG. 12, a vertical alignment foot 82 is optionally disposed in a bore 86 formed in the body 70. The foot 82 is adapted for reliable and accurate vertical positioning of the tip opening 74 over the substrate during dispensing of the material. The foot 82 may be formed of a number of materials, including heat-treated steel optimized for wear resistance, as well as plastic, investment casting, injection mold, stainless steel, or titanium, and may be press-fit, bonded, or welded into the body 70. The foot 82 may optionally be formed to include a radiused end 83, to allow for contact with the substrate without damaging the substrate, for example for applying a line of material to the substrate, as described above with reference to FIG. 8B.

Figure 13:
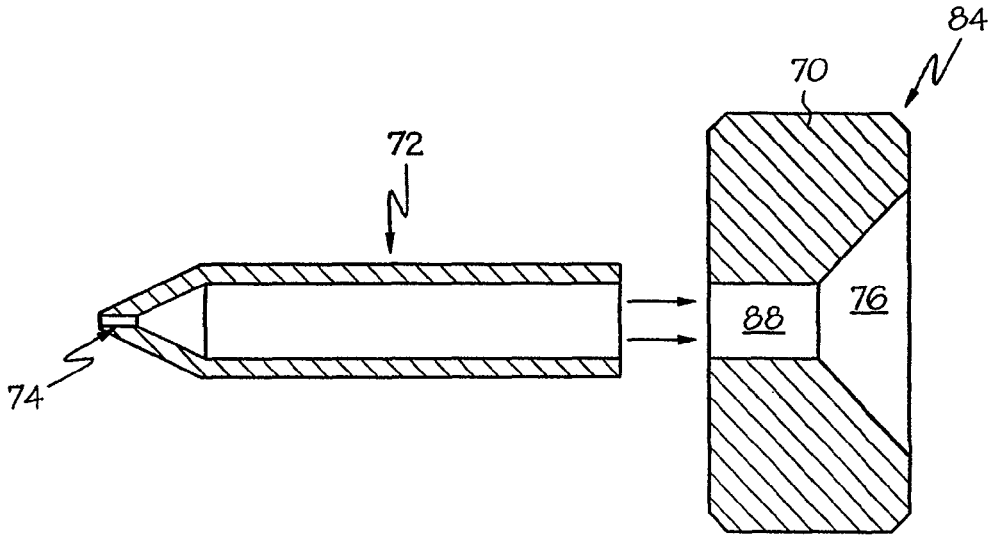
FIG. 13 is a cutaway side view of a machined neck being applied to a body in accordance with the present invention.

FIG. 13 is a cutaway side view of a dispense tip 84 formed by the combination of a separately machined neck 72 joined to body 70. The neck 72 is machined in the manner described above and preferably includes the advantageous configuration of a tapered inner diameter as described above. A bore 88 is formed in the body and the neck 72 is press-fit, bonded, or welded into position in the bore 88.

Figure 14A:
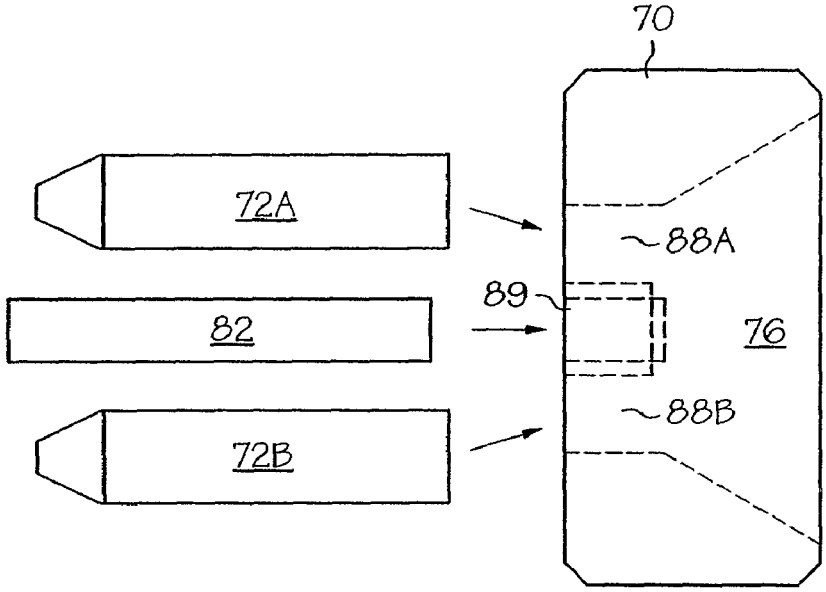
FIG. 14A is an exploded side view of a dual-neck embodiment including a spacer foot, in accordance with the present invention.
Figure 14B:
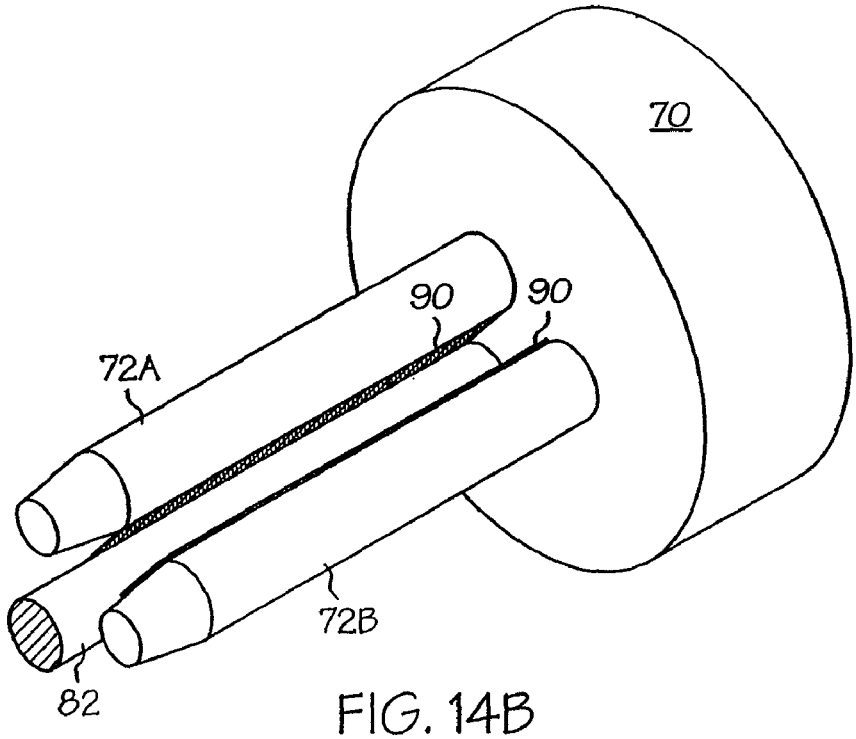
FIG. 14B is a perspective view of the assembled dispense tip of FIG. 14A, in accordance with the present invention.

FIG. 14A is an exploded perspective view of a dual-dispense tip embodiment, including first and second tips 72A, 72B machined separately as described above, and joined to a body 70 having first and second apertures 88A, 88B communicating with a dual output funnel 76. An alignment foot 82 is likewise aligned with, and disposed in, bore 89. The resulting dual-dispense tip is shown in perspective in FIG. 14B. Once aligned, the necks 72A, 72B may be bonded to the foot 82 using epoxy 90 to ensure rigidity and alignment throughout the lifetime of the dispense tip. Alternative embodiments including, for example, three or four dispense tips are equally applicable to the present invention.

Figure 15A:
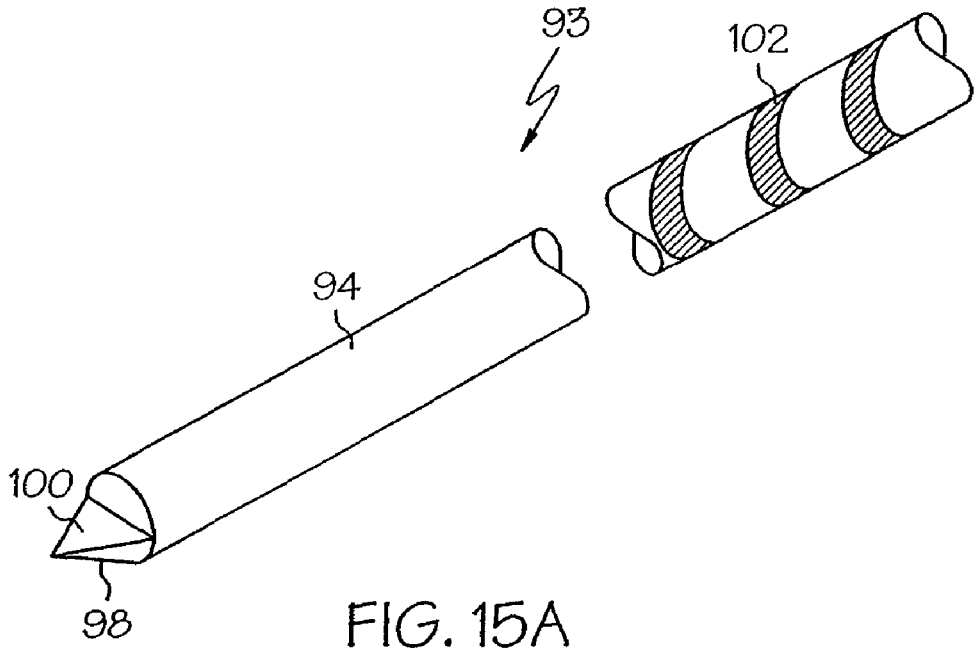
FIG. 15A and FIG. 15B are perspective and side views respectively of a tool for cleaning a dispense tip having a tapered neck in accordance with the present invention.
Figure 15B:
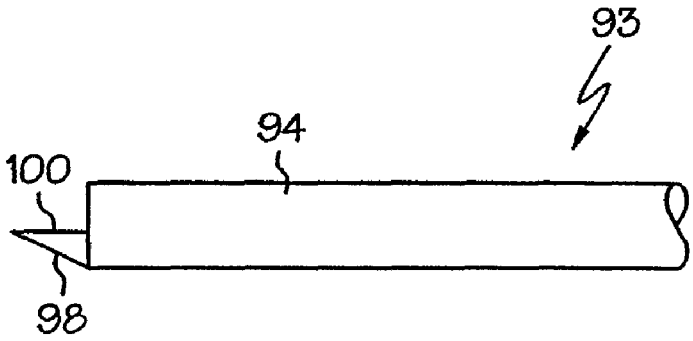

To extend dispense tip lifetime, the present invention is further directed, in a fourth aspect, to a cleaning tool 93 as shown in the perspective and side views respectively of FIG. 15A and FIG. 15B. The cleaning tool 93 includes an elongated body 94 that serves as a handle during a cleaning operation, and a sharpened surface, referred to herein as a "shovel" 100, adapted to interface with the tapered inner diameter of the neck 72, as described above. The body 94 of the cleaning tool is preferably of a diameter slightly less than the diameter of the larger first diameter $D_1$ of the neck, while the angle of the bevel 98 is adapted to match the angle $\alpha$ of the inner taper 80 of the neck. Drill flutes 102 may be provided on the body 94 of the cleaning tool 94, for providing an initial cleaning of the contaminated region, and for transporting a bulk of the material from the neck region.

Figure 16A:
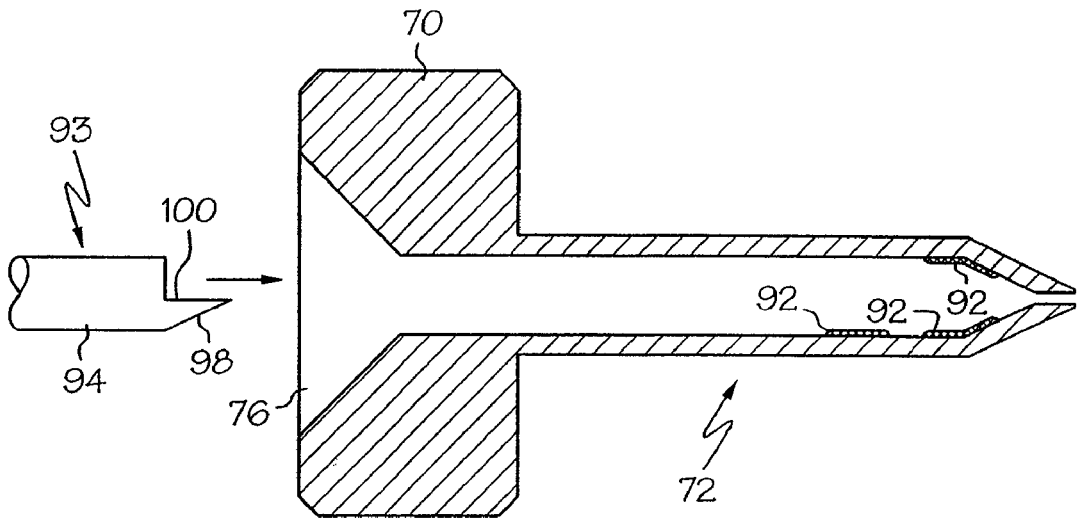
FIG. 16A and FIG. 16B are side views illustrating cleaning of the tip using the tool of FIGS. 15A and 15B in accordance with the present invention.
Figure 16B:
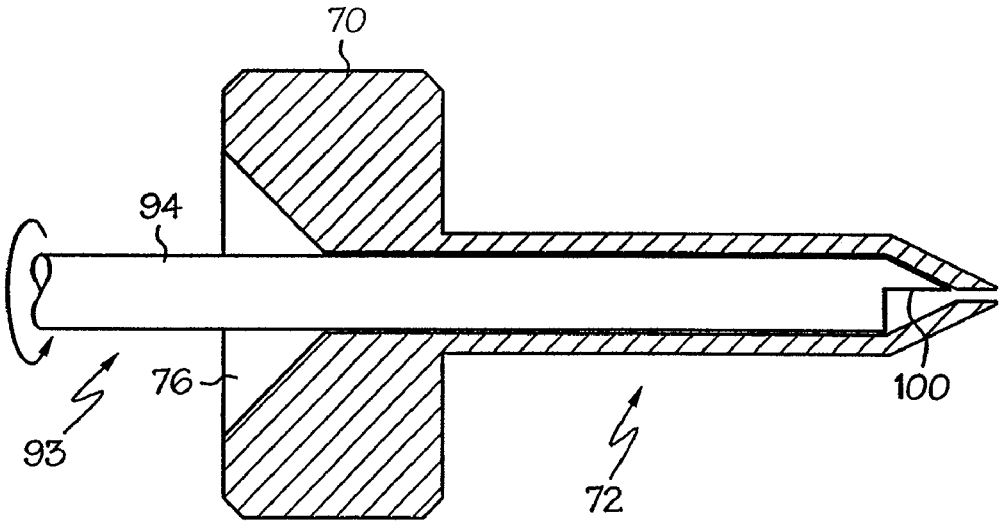

A cleaning operation using the cleaning tool 93 is illustrated in the side view of FIG. 16A and FIG. 16B. As shown in FIG. 16A, material residue 92 is deposited on an inner surface of the neck 72. The end of the cleaning tool 93 having drill flutes is inserted and rotated in the neck for removing a bulk of the residual material from the inner surface of the neck. The cleaning tool 93 is next inserted in the rear portion of the dispense tip at funnel 76. As shown in FIG. 16B, the cleaning tool 93 is inserted and rotated so as to remove the material 92 from the inner surfaces of the neck. The cleaning tool 94 is beveled at its distal end 98 such that the tip interfaces with the tapered portion, as shown. The sharpened shovel 100 scrapes residue from the tapered portion of the neck. As shown in FIG. 16B, the residual material is substantially removed from the inner surface by the cleaning tool 93.

Figure 17:
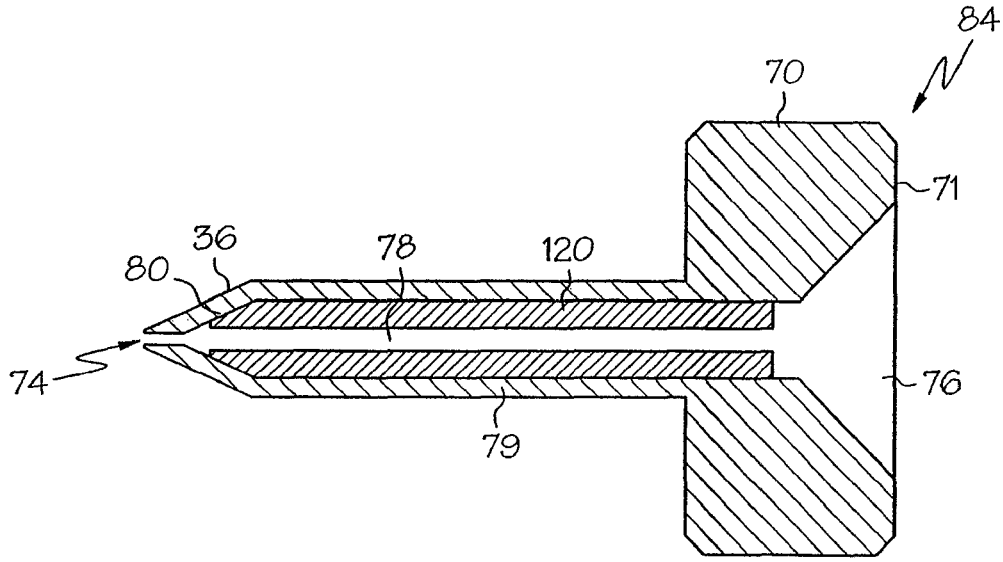
FIG. 17 is a cutaway side view of a unitary tip having a tubular liner inserted in the neck of the tip in accordance with the present invention.

In another aspect of the present invention, the dispense tip 84 includes a tubular sleeve or insert 120 positioned within the neck, as shown in the cutaway side view of FIG. 17. The tubular insert may comprise, for example a Teflon™ tube liner 120 cut in length to match the length of the neck of the dispense tip between the inner taper 80, and the funnel 76.

As explained above, the unitary machined dispense tips of FIGS. 11-14 with a tapered inner diameter offer the advantages of increased material flow, and operation at lower pressure, resulting in improved dispensing accuracy and increased throughput. However, as the viscosity of the material for deposit is lowered, the material tends to flow through the neck more quickly, such that if the inner diameter of the neck is too large, the resulting deposit may be too wide in diameter. The tubular neck insert 120 serves to narrow the neck width such that a given machined dispense tip can be made to be compatible with a variety of materials, including low-viscosity materials, simply by applying a sleeve of appropriate inner diameter. The lined embodiment is beneficial for forming dispense tips having inner diameters too small to machine. The effective inner diameter of the dispense tip is thus defined by the inner diameter of the liner, which can be easily adjusted by removing and inserting different liners. This embodiment confers the additional advantage of simplified tip cleaning, as the liner can be readily removed and discarded.

Figure 18A:
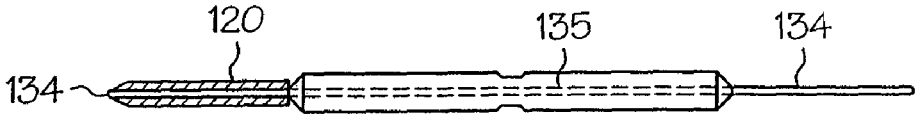
FIGS. 18A-18D are cutaway side views of the tip of FIG. 17, showing insertion of the liner with a liner insertion tool in accordance with the present invention.
Figure 18B:
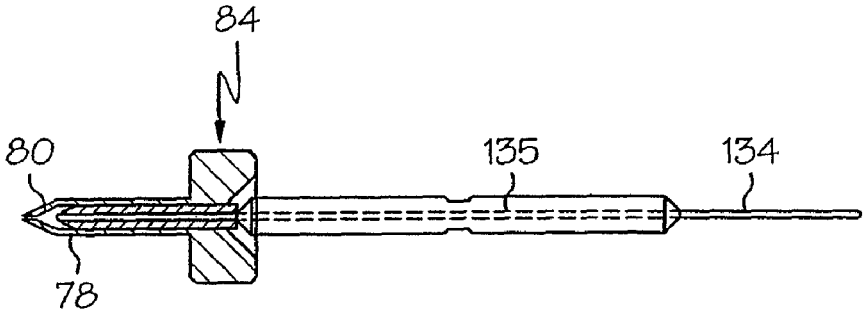
Figure 18C:
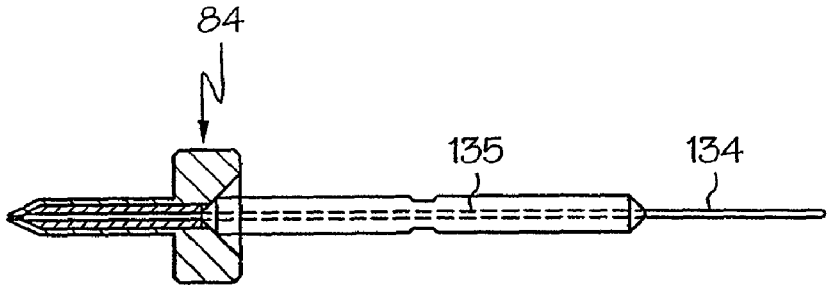
Figure 18D:
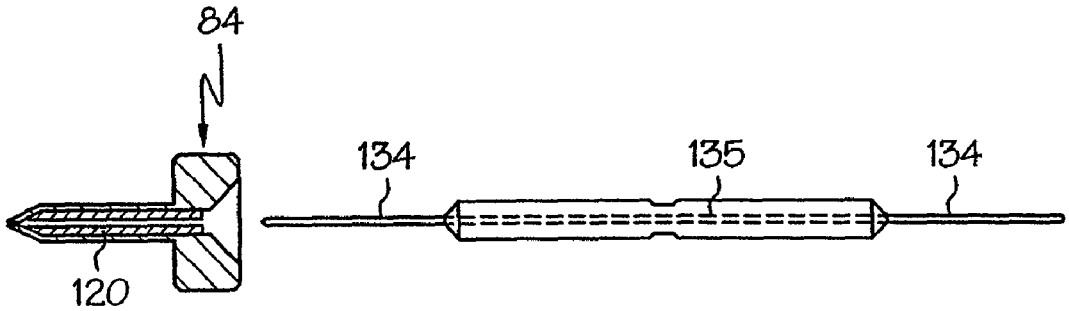

The liner 120 may be inserted, for example, using an insertion tool 130 according to the process illustrated in FIGS. 18A-18D. The liner insertion tool 130 may comprise, for example, an elongated wire 134, of a diameter smaller than the inner diameter of the insert 120. The wire is passed through a soft casing 135 comprising, for example, rubber or plastic, that serves jointly as a handle for the insertion tool, and as a stop to urge the liner into the tip during insertion. As shown in FIG. 18A, one end of the tool is inserted entirely through the hole in the liner 120, thereby ensuring the liner is not blocked. In FIG. 18B, the liner is pushed into the neck opening in the funnel of the dispense tip 84. During insertion, an end of the handle 135 urges the liner into the neck opening 78, as shown in FIG. 18C. The taper 80 at the distal end of the neck 78, near its opening 74, prevents further insertion of the tube 120 into the neck, and serves to retain the liner 120 in the neck 78 as the insertion tool 130 is withdrawn, as shown in FIG. 18D. The lined dispense tip 84 is now ready for operation. The liner may be removed by twisting a fluted drill bit of appropriate diameter into the end of the liner at funnel 76, so as to cut into the inner walls of the liner. The liner 120 is then withdrawn form the neck with the drill bit.

Figure 19:
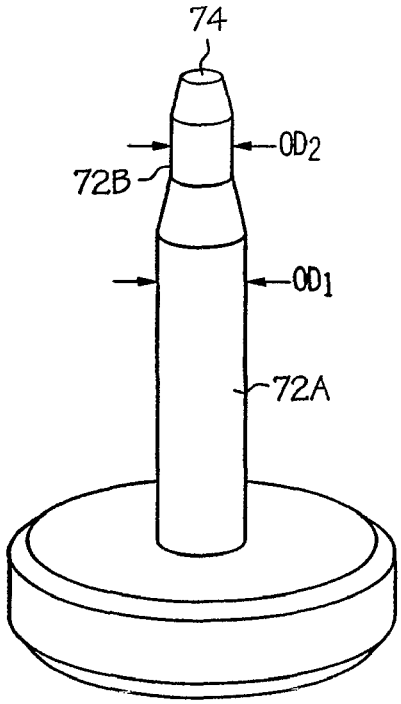
FIG. 19 is a perspective view of a unitary tip having a reduced diameter in the region proximal to the tip opening, in accordance with the present invention.

FIG. 19 is a perspective view of a unitary dispense tip having a reduced outer diameter OD2 in the region proximal to the tip opening, referred to herein as a "relieved" dispense tip. The relieved tip is formed with a neck 72 of standard first outer diameter OD1. The relieved region of the neck 72B proximal to the neck opening 74 is machined further to a narrower second outer diameter OD2. The reduced second outer diameter allows for the dispense tip to be positioned closer to the side of an object on the substrate, for example for underfill or encapsulation of integrated circuits or "flip chips". The longitudinal length of the relieved neck region 72B is a function of the thickness of the object being encapsulated.

Figure 20:
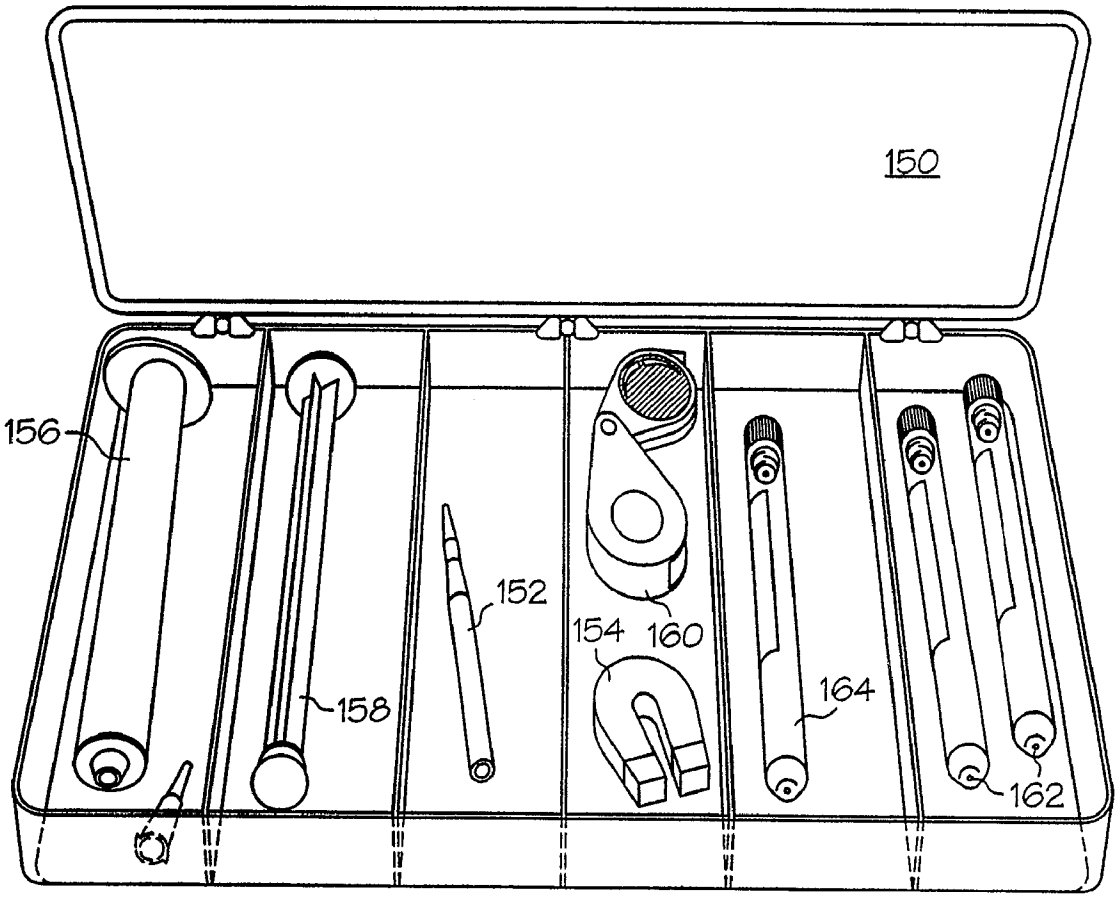
FIG. 20 is a perspective view of a dispense tip cleaning kit in accordance with the present invention.

In another aspect of the present invention, a cleaning kit as shown in FIG. 20 further enables cleaning of the dispense tips. Such a kit is preferably enclosed in a plastic, non-scratch compartmentalized receptacle 150, and includes a pin-vise 152, magnet 154, syringe 156 and plunger 158, magnifying glass 160, cleaning wires 162 and cleaning tools 164. The pin vise 152 is adapted to secure the miniature wires and drills during a cleaning operation. The magnet 154 is helpful for locating the wires and drills on a work surface, for example by using a sweeping motion of the magnet over the surface. The syringe and plunger 156, 158 are provided for flushing out the dispense tips following cleaning with the wires and fluted drill bits. Alcohol is a preferred liquid for the flushing operation. A magnifying glass 160 helps with inspection of the dispense tips during, and following, cleaning. Cleaning wires 162 include cleaning wires with tapered ends for eased insertion into the dispense tips. Cleaning tools 164 include fluted drill bits for coarse cleaning of the inner necks, a shoveled cleaning tool, described above, for cleaning the inner taper of unitary dispense tips, and a liner insertion tool, described above, for inserting liners into the unitary dispense tips.

Commonly dispensed materials include solder paste, conductive epoxy, surface mount epoxy, solder mask, two-part epoxy (for encapsulation), two-part epoxy underfill, oils, flux, silicone, gasket materials, glues, and medical reagents. The dispense tips may be formed of a number of applicable materials, including stainless steel, ceramics, composites, glass, and molded epoxy.

While this invention has been particularly shown and described with references to preferred embodiments thereof, it will be understood by those skilled in the art that various changes in form and detail may be made therein without departing from the spirit and scope of the invention as defined by the appended claims.

I claim:

1. A dispense tip comprising:

an elongated neck having a longitudinal axis;

an elongated hole in the neck, the hole extending from an input end region of the neck to an output end region of the neck, a portion of the elongated hole having an inner surface of a first inner diameter, and the output end region including an outlet having an inner surface of a second inner diameter, the first inner diameter being greater than the second inner diameter, wherein the outlet having the inner surface of the second inner diameter has a first length in a direction along the longitudinal axis;

an inner taper that transitions the inner surface of the hole from the first inner diameter to the second inner diameter, the hole being unobstructed within the first inner diameter and the second inner diameter between the input end region of the neck and the outlet in the output end region of the neck, wherein a portion of the inner taper is in the output end region;

a body at the input end region of the neck, the body including a funnel that delivers fluid to the input end region of the neck, the dispense tip constructed and arranged to receive a flow of the fluid from a material pump during a dispensing operation, the funnel having a funnel inlet at an input end of the funnel that is constructed and arranged to receive the flow of the fluid from the material pump and a funnel outlet at an output end of the funnel, wherein the input end region of the neck communicates with the funnel outlet such that the dispense tip includes a single, unidirectional fluid path between the funnel inlet and the output end region of the neck, wherein at least one of the neck and the body of the dispense tip comprises ceramics; and a bevel about a outermost end of the output end region of the neck, wherein the outlet extends from the inner taper to the outermost end, the bevel having an outer surface of a second length in a direction along the longitudinal axis, wherein the second length of the bevel surface is greater than the first length of the outlet, and wherein the bevel surface lies at an acute angle relative to the longitudinal axis at the outermost end of the output end region of the neck.

2. The dispense tip of claim 1, wherein at least one of the neck and the body is formed by molding.

3. The dispense tip of claim 1, wherein the inner taper is proximal to the output end region of the neck.

4. The dispense tip of claim 1, wherein the portion of the elongated hole having the inner surface of the first inner diameter is proximal to the input end region of the neck.

5. The dispense tip of claim 1, wherein the portion of the elongated hole having the inner surface of the first inner diameter is proximal to the output end region of the neck.

6. The dispense tip of claim 1, wherein at least the output end region of the neck is electropolished.

7. The dispense tip of claim 1 wherein the inner taper is formed at an angle of approximately 20 degrees relative to the longitudinal axis.

8. The dispense tip of claim 1 wherein the body and the neck are unitary.

9. The dispense tip of claim 8, wherein the unitary body and neck are formed from a common ceramic material.

10. The dispense tip of claim 1 wherein the body is formed separately from the neck and wherein the body and neck are coupled by mounting the neck to the body

11. The dispense tip of claim 10, wherein the neck comprises ceramics and the body comprises at least one of stainless steel, ceramics, composites, glass, and epoxy.

12. The dispense tip of claim 10, wherein the body and neck are coupled by a coupling technique selected from a group of coupling techniques consisting of press-fitting, bonding, and welding.

13. The dispense tip of claim 1, wherein the neck comprises ceramics.

14. The dispense tip of claim 1 further comprising an alignment foot coupled to the body, the foot having a primary axis substantially parallel to the longitudinal axis of the neck, and being of a length longer than the neck.

15. The dispense tip of claim 1, wherein the funnel of the body includes a plurality of funnel outlets at the output end, and wherein the dispense tip comprises a like plurality of the elongated necks, each elongated neck including a hole having a single cylindrical input end and a single cylindrical output end, the input end of which communicates with one of the funnel outlets such that a single, unobstructed fluid path is provided between each funnel outlet and the output end region of each neck.

16. The dispense tip of claim 1 further comprising an outer taper along an outer surface of the neck such that an input end region of the neck has a first outer diameter, and such that the output end region of the neck has a second outer diameter, the first outer diameter being greater than the second outer diameter, the outer taper transitioning the outer surface of the neck from the first outer diameter to the second outer diameter.

17. The dispense tip of claim 16 wherein the outer taper is formed in a region of the neck that corresponds with the position of the inner taper.

18. A dispense tip comprising:

an elongated neck having a longitudinal axis;

an elongated hole in the neck, the hole extending from an input end region of the neck to an output end region of the neck, a portion of the elongated hole having an inner surface of a first inner diameter, and the output end region including an outlet having an inner surface of a second inner diameter, the first inner diameter being greater than the second inner diameter, wherein the outlet having the inner surface of the second inner diameter has a first length in a direction along the longitudinal axis;

an inner taper proximal to the output end region that transitions the inner surface of the hole from a diameter equal to or less than the first inner diameter and greater than the second inner diameter to the second inner diameter, the hole being unobstructed within the first inner diameter and the second inner diameter between the input end region of the neck and the outlet in the output end region of the neck;

a body at the input end region of the neck, the body including a funnel that delivers fluid to the input end region of the neck, the dispense tip constructed and arranged to receive a flow of the fluid from a material pump during a dispensing operation, the funnel having a funnel inlet at an input end of the funnel that is constructed and arranged to receive the flow of the fluid from the material pump and a funnel outlet at an output end of the funnel, wherein the input end region of the neck communicates with the funnel outlet such that the dispense tip includes a single, unidirectional fluid path between the funnel inlet and the output end region of the neck, wherein at least one of the neck and the body of the dispense tip comprises ceramics; and a bevel about a outermost end of the output end region of the neck, wherein the outlet extends from the inner taper to the outermost end, the bevel having an outer surface of a second length in a direction along the longitudinal axis, wherein the second length of the bevel is greater than the first length of the outlet, and wherein the bevel surface lies at an acute angle relative to the longitudinal axis at the outermost end of the output end region of the neck.

19. The dispense tip of claim 18, wherein at least one of the neck and the body is formed by molding.

20. The dispense tip of claim 18, wherein the portion of the elongated hole having the inner surface of the first inner diameter is proximal to the input end region of the neck.

21. The dispense tip of claim 18, wherein the portion of the elongated hole having the inner surface of the first inner diameter is proximal to the output end region of the neck.

22. The dispense tip of claim 18, wherein at least the output region of the neck is electropolished.

23. The dispense tip of claim 18 wherein the inner taper is formed at an angle of approximately 20 degrees relative to the longitudinal axis.

24. The dispense tip of claim 18 wherein the body and the neck are unitary.

25. The dispense tip of claim 24, wherein the unitary body and neck are formed from a common ceramic material.

26. The dispense tip of claim 18 wherein the body is formed separately from the neck and wherein the body and neck are coupled by mounting the neck to the body.

27. The dispense tip of claim 26, wherein the neck comprises ceramics and the body comprises at least one of stainless steel, ceramics, composites, glass, and epoxy.

28. The dispense tip of claim 18, wherein the neck comprises ceramics.

29. A method of forming a dispense tip comprising:

forming an elongated neck having a longitudinal axis;

forming an elongated hole in the neck, the hole extending from an input end region of the neck to an output end region of the neck, a portion of the elongated hole having an inner surface of a first inner diameter, and the output end region including an outlet having an inner surface of a second inner diameter, the first inner diameter being greater than the second inner diameter, wherein the outlet having the inner surface of the second inner diameter has a first length in a direction along the longitudinal axis;

forming an inner taper that transitions the inner surface of the hole from the first inner diameter to the second inner diameter, the hole being unobstructed within the first inner diameter and the second inner diameter between the input end region of the neck and the outlet in the output end region of the neck, wherein a portion of the inner taper is in the output end region;

forming a body at the input end region of the neck, the body including a funnel that delivers fluid to the input end region of the neck, the body constructed and arranged to receive a flow of the fluid from a material pump during a dispensing operation, the funnel having a funnel inlet at an input end of the funnel and a funnel outlet at an output end of the funnel, that is constructed and arranged to receive the flow of the fluid from the material pump, wherein the input end region of the neck communicates with the funnel outlet such that the dispense tip includes a single, unidirectional fluid path between the funnel inlet and the output end region of the neck, wherein at least one of the neck and the body of the dispense tip comprises ceramics; and forming a bevel about an outermost end of the output end region of the neck, wherein the outlet extends from the inner taper to the outermost end, the bevel having an outer surface of a second length in a direction along the longitudinal axis, wherein the second length of the bevel surface is greater than the first length of the outlet, and wherein the bevel surface lies at an acute angle relative to the longitudinal axis at the outermost end of the output end region of the neck.

30. The method of claim 29, wherein at least one of the neck and the body is formed by molding.

31. The method of claim 29, wherein the inner taper is proximal to the output end region of the neck.

32. The method of claim 29, wherein the portion of the elongated hole having the inner surface of the first inner diameter is proximal to the input end region of the neck.

33. The method of claim 29, wherein the portion of the elongated hole having the inner surface of the first inner diameter is proximal to the output end region of the neck.

34. The method of claim 29, wherein at least the output end region of the neck is electropolished.

35. The method of claim 29, wherein the inner taper is formed at an angle of approximately 20 degrees relative to the longitudinal axis.

36. The method of claim 29, wherein the body and the neck are unitary.

37. The method of claim 36, wherein the unitary body and neck are formed from a common ceramic material.

38. The method of claim 29, wherein the body is formed separately from the neck and wherein the body and neck are coupled by mounting the neck to the body.

39. The method of claim 38, wherein the neck comprises ceramics and the body comprises at least one of stainless steel, ceramics, composites, glass, and epoxy.

40. The method of claim 38, wherein the body and neck are coupled by a coupling technique selected from a group of coupling techniques consisting of press-fitting, bonding, and welding.

41. The method of claim 29, wherein the neck comprises ceramics.

42. The method of claim 29, wherein an alignment foot is coupled to the body, the foot having a primary axis substantially parallel to the longitudinal axis of the neck, and being of a length longer than the neck.

43. The method of claim 29, wherein the funnel of the body includes a plurality of funnel outlets at the output end, and wherein the dispense tip comprises a like plurality of the elongated necks, each elongated neck including a hole having a single cylindrical input end and a single cylindrical output end, the input end of which communicates with one of the funnel outlets such that a single, unobstructed fluid path is provided between each funnel outlet and the output end region of each neck.

44. The method of claim 29 further comprising an outer taper along an outer surface of the neck such that an input end region of the neck has a first outer diameter, and such that the output end region of the neck has a second outer diameter, the first outer diameter being greater than the second outer diameter, the outer taper transitioning the outer surface of the neck from the first outer diameter to the second outer diameter.

45. The method of claim 29, wherein the outer taper is formed in a region of the neck that corresponds with the position of the inner taper.

46. A dispense tip comprising:

an elongated neck having a longitudinal axis;

an elongated hole in the neck, the hole extending from an input end region of the neck to an output end region of the neck, a portion of the elongated hole having an inner surface of a first inner diameter, and the output end region including an outlet having an inner surface of a second inner diameter, the first inner diameter being greater than the second inner diameter, wherein the outlet having the inner surface of the second inner diameter has a first length in a direction along the longitudinal axis;

an inner taper that transitions the inner surface of the hole from the first inner diameter to the second inner diameter, the hole being unobstructed within the first inner diameter and the second inner diameter between the input end region of the neck and the outlet in the output end region of the neck, wherein a portion of the inner taper is in the output end region;

a body at the input end region of the neck, the body including a funnel that delivers fluid to the input end region of the neck, the dispense tip constructed and arranged to receive a flow of the fluid from a material pump during a dispensing operation, the funnel having a funnel inlet at an input end of the funnel that is constructed and arranged to receive the flow of the fluid from the material pump and a funnel outlet at an output end of the funnel, wherein the input end region of the neck communicates with the funnel outlet such that the dispense tip includes a single, unidirectional fluid path between the funnel inlet and the output end region of the neck, wherein at least one of the neck and the body of the dispense tip comprises composites; and a bevel about a outermost end of the output end region of the neck, wherein the outlet extends from the inner taper to the outermost end, the bevel having an outer surface of a second length in a direction along the longitudinal axis, wherein the second length of the bevel surface is greater than the first length of the outlet, and wherein the bevel surface lies at an acute angle relative to the longitudinal axis at the outermost end of the output end region of the neck.

47. A dispense tip comprising:

an elongated neck having a longitudinal axis;

an elongated hole in the neck, the hole extending from an input end region of the neck to an output end region of the neck, a portion of the elongated hole having an inner surface of a first inner diameter, and the output end region including an outlet having an inner surface of a second inner diameter, the first inner diameter being greater than the second inner diameter, wherein the outlet having the inner surface of the second inner diameter has a first length in a direction along the longitudinal axis;

an inner taper proximal to the output end region that transitions the inner surface of the hole from a diameter equal to or less than the first inner diameter and greater than the second inner diameter to the second inner diameter, the hole being unobstructed within the first inner diameter and the second inner diameter between the input end region of the neck and the outlet in the output end region of the neck;

a body at the input end region of the neck, the body including a funnel that delivers fluid to the input end region of the neck, the dispense tip constructed and arranged to receive a flow of the fluid from a material pump during a dispensing operation, the funnel having a funnel inlet at an input end of the funnel that is constructed and arranged to receive the flow of the fluid from the material pump and a funnel outlet at an output end of the funnel, wherein the input end region of the neck communicates with the funnel outlet such that the dispense tip includes a single, unidirectional fluid path between the funnel inlet and the output end region of the neck, wherein at least one of the neck and the body of the dispense tip comprises composites; and a bevel about a outermost end of the output end region of the neck, wherein the outlet extends from the inner taper to the outermost end, the bevel having an outer surface of a second length in a direction along the longitudinal axis, wherein the second length of the bevel surface is greater than the first length of the outlet, and wherein the bevel surface lies at an acute angle relative to the longitudinal axis at the outermost end of the output end region of the neck.

48. A method of forming a dispense tip comprising:

forming an elongated neck having a longitudinal axis;

forming an elongated hole in the neck, the hole extending from an input end region of the neck to an output end region of the neck, a portion of the elongated hole having an inner surface of a first inner diameter, and the output end region including an outlet having an inner surface of a second inner diameter, the first inner diameter being greater than the second inner diameter, wherein the outlet having the inner surface of the second inner diameter has a first length in a direction along the longitudinal axis;

forming an inner taper that transitions the inner surface of the hole from the first inner diameter to the second inner diameter, the hole being unobstructed within the first inner diameter and the second inner diameter between the input end region of the neck and the outlet in the output end region of the neck, wherein a portion of the inner taper is in the output end region;

forming a body at the input end region of the neck, the body including a funnel that delivers fluid to the input end region of the neck, the body constructed and arranged to receive a flow of the fluid from a material pump during a dispensing operation, the funnel having a funnel inlet at an input end of the funnel that is constructed and arranged to receive the flow of the fluid from the material pump and a funnel outlet at an output end of the funnel, wherein the input end region of the neck communicates with the funnel outlet such that the dispense tip includes a single, unidirectional fluid path between the funnel inlet and the output end region of the neck, wherein at least one of the neck and the body of the dispense tip comprises composites; and forming a bevel about an outermost end of the output end region of the neck, wherein the outlet extends from the inner taper to the outermost end, the bevel having an outer surface of a second length in a direction along the longitudinal axis, wherein the second length of the bevel surface is greater than the first length of the outlet, and wherein the bevel surface lies at an acute angle relative to the longitudinal axis at the outermost end of the output end region of the neck.

* * * * *

UNITED STATES PATENT AND TRADEMARK OFFICE

CERTIFICATE OF CORRECTION

PATENT NO. : 7,744,022 B1
APPLICATION NO. : 11/733517
DATED : June 29, 2010
INVENTOR(S) : Jeffrey P. Fugere It is certified that error appears in the above-identified patent and that said Letters Patent is hereby corrected as shown below:

Column 10, line 5 delete "a" and insert --an-- (2nd occurrence)
Column 11, line 35 delete "a" and insert --an-- (2nd occurrence)
Column 13, line 63 delete "a" and insert --an-- (2nd occurrence)
Column 14, line 40 delete "a" and insert --an-- (2nd occurrence)

Signed and Sealed this

Twenty-sixth Day of October, 2010

David J. Kappos

David J. Kappos
*Director of the United States Patent and Trademark Office*